US006750819B2

(12) United States Patent
Rahaim et al.

(10) Patent No.: US 6,750,819 B2
(45) Date of Patent: Jun. 15, 2004

(54) SENSOR COVER AND METHOD OF CONSTRUCTION THEREOF

(75) Inventors: Samuel G. Rahaim, Ann Arbor, MI (US); Robert Joseph Gordon, Livonia, MI (US); Paul Kirk Zoratti, South Lyon, MI (US); Timothy Arthur Tiernan, Redford, MI (US); Robert Edward Belke, West Bloomfield, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 162 days.

(21) Appl. No.: 10/044,761

(22) Filed: Jan. 10, 2002

(65) Prior Publication Data

US 2003/0128164 A1 Jul. 10, 2003

(51) Int. Cl.[7] ..... H01Q 1/38
(52) U.S. Cl. ..... 343/700 MS; 343/872; 342/13
(58) Field of Search ..... 343/872, 700 MS, 343/909, 911 R; 342/13, 3, 4, 175

(56) References Cited

U.S. PATENT DOCUMENTS

| | | | | |
|---|---|---|---|---|
| 4,952,937 | A | 8/1990 | Allen | 342/20 |
| 5,036,323 | A | 7/1991 | Cain et al. | 342/6 |
| 5,438,333 | A | 8/1995 | Perkins et al. | 342/4 |
| 5,652,652 | A | 7/1997 | Jones et al. | 356/28 |
| 6,111,551 | A | 8/2000 | Schmidt et al. | 343/872 |
| 6,184,842 | B1 | 2/2001 | Leinweber et al. | 343/872 |
| 6,328,358 | B1 | 12/2001 | Berweiler | |
| 2002/0011946 | A1 * | 1/2002 | Artis et al. | 342/13 |

FOREIGN PATENT DOCUMENTS

| | | |
|---|---|---|
| DE | 197 24 320 A1 | 12/1998 |
| DE | 100 53 517 A1 | 5/2002 |
| EP | 0 343 813 | 11/1989 |
| GB | 116544 | 10/1969 |

OTHER PUBLICATIONS

English Abstract of German Patent No. 197 24 320 A1.
English Abstract of German Patent No. 100 53 517 A1.

* cited by examiner

*Primary Examiner*—Hoang V. Nguyen
(74) *Attorney, Agent, or Firm*—Brinks Hofer Gilson & Lione

(57) ABSTRACT

A sensor cover is disclosed for camouflaging a high frequency sensor, including for example, a radar sensor. The sensor cover includes a substrate having a non-planar surface with non-signal transmitting regions and signal transmitting regions. A metal layer is disposed on each of the non-signal transmitting regions. Further, each of the non-signal transmitting regions is separated by one of the signal transmitting regions. The method of constructing such a sensor cover is also disclosed.

19 Claims, 6 Drawing Sheets

SENSOR COVER AND METHOD OF CONSTRUCTION THEREOF

TECHNICAL FIELD

The present invention relates generally to a radar sensor cover and, more specifically, to a sensor cover that allows minimal radar signal attenuation and minimal radiation pattern distortion.

BACKGROUND

The use of high frequency sensors in automotive detection and control systems is becoming more prevalent. One type of high frequency sensor frequently used in vehicular applications is a radar sensor. For example, adaptive cruise control (ACC) systems utilize a radar sensor to control the speed and distance of a vehicle equipped with an ACC system and a target vehicle. For aesthetic purposes, it is advantageous to hide the sensor components from view. However, the customary materials that are used for exterior vehicular shells, namely metals, are not transparent to the high frequency waves, including radar waves.

There are several prior art cover designs that are used to hide or camouflage the sensor components. One known cover design is made from an opaque non-metallic material that is essentially transparent to high frequency signals. A disadvantage of this type of cover is that the cover does not contain any metal and therefore does not blend in with the body of the vehicle.

Another known sensor cover design includes a very thin planar layer of metal. Such a structure is disclosed in U.S. Pat. No. 6,184,842 B1. The sensor cover in this disclosure includes a covering member formed of a radar-transparent material, an area formed on the surface of the radar-transparent material in the shape of a selected characteristic structure or symbol, a visible metallic or metallically glossy layer on the structure or symbol where the thickness of the metallic or metallically glossy layer is such that electromagnetic radiation of the radar system penetrates it substantially without attenuation. A disadvantage of this type of system is that the metallic area must be minimal to obtain minimal signal attenuation.

Thus, there is a need for metallic sensor covers that allow for a large metallic area and that provide minimal sensor signal attenuation. This invention provides such an improved/new and useful sensor cover.

BRIEF SUMMARY

The present invention overcomes the disadvantages described above of known sensor covers. An aspect of this invention is to form a high frequency electromagnetic wave transparent cover that can be designed as a decorative structure, such as a logo or manufacturer nameplate, or as any vehicle component, such as a grill. The cover is therefore aesthetically pleasing, while also providing the advantage of allowing transmission of high frequency electromagnetic waves, including radar waves, with minimal interference. This invention will disclose several constructions that have a metallic appearance from an elevational view, but allow high frequency wave transmission.

The present invention provides a sensor cover for camouflaging a high frequency electromagnetic wave transmitting sensor. The sensor cover includes a substrate having a non-planar surface wherein the surface has non-signal transmitting regions and signal transmitting regions. Each of the non-signal transmitting regions is separated by at least one of the signal transmitting regions. A metallic layer is disposed on each of the non-signal transmitting regions of the substrate.

The distance between the metal adhered non-signal transmitting regions and the repeat pattern of the metal adhered non-signal transmitting regions provide the visual appearance of a solid metal layer while allowing minimal attenuation and minimal radiation pattern or beam distortion of the sensor signal. The cover of the present invention may be used with a high frequency sensor is capable of both transmitting and receiving signals.

In another aspect of the present invention a method of constructing a sensor cover for camouflaging a high frequency sensor is provided. The method includes the steps of: A) forming a substrate having a non-planar surface, where the non-planar surface includes non-signal transmitting regions separated by signal transmitting regions; and B) adhering a metal layer on each of the non-signal transmitting regions of the substrate.

DETAILED DESCRIPTION

The following description of the preferred embodiment of the invention is not intended to limit the invention to this preferred embodiment, but rather to enable any person skilled in the art of high frequency sensor coverings to make and use this invention.

Figure 1:
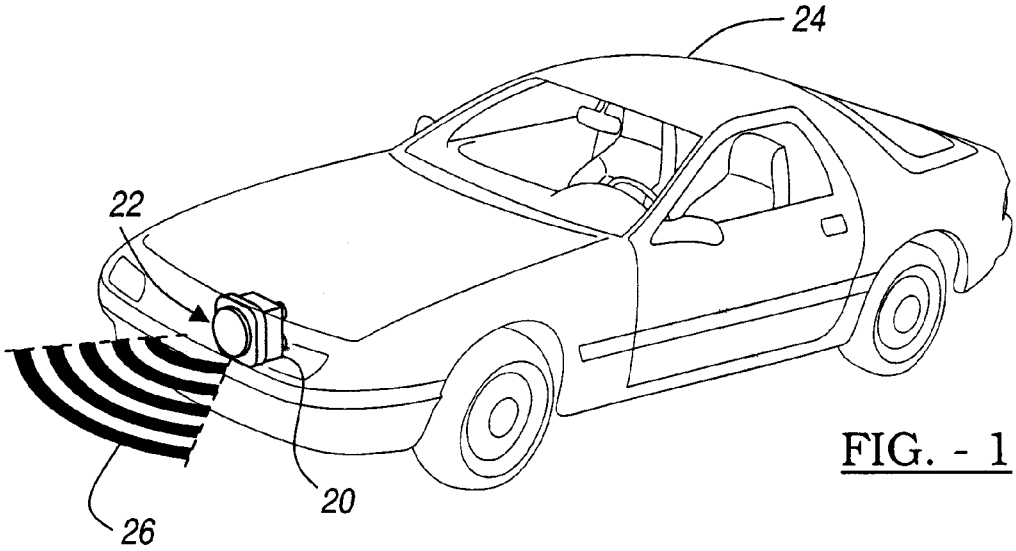
FIG. 1 is a perspective view of a vehicle including one embodiment of the present invention.

The high frequency sensor covering is used to camouflage a high frequency sensor, for example, a radar sensor. The high frequency sensor is capable of transmitting and receiving sensor signals. As shown in FIG. 1, the radar sensor 20 and cover, shown generally at 22, can be mounted to a vehicle 24, although it is important to note that this invention is not limited to sensors and coverings used in association with vehicles. The radar sensor 20 and cover 20 are shown mounted in the front region of the vehicle 24 in FIG. 1, however, this invention includes sensors and covers that are mounted at any position on the vehicle.

Figure 2:
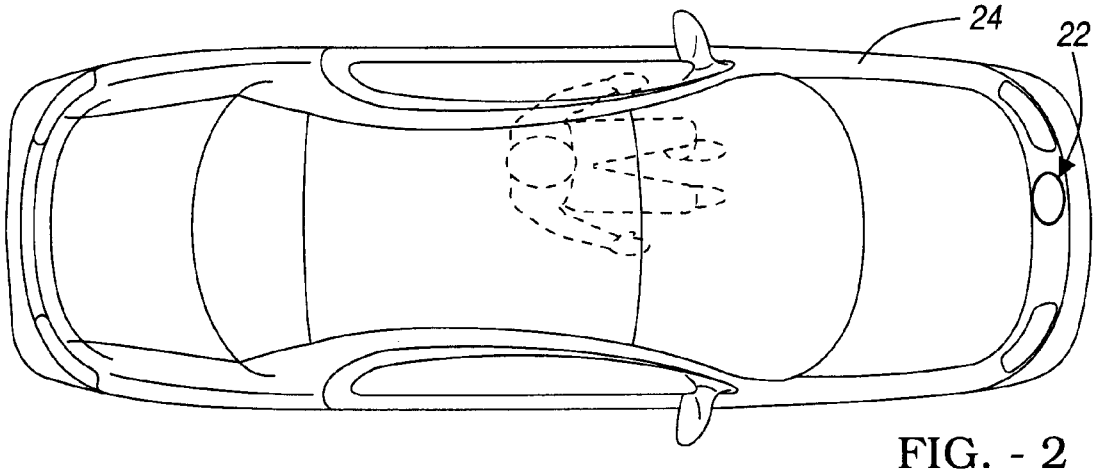
FIG. 2 is a top view of a vehicle including one embodiment of the present invention.

The cover 22 masks the location of the sensor 20 yet allows the radar signals 26 to pass through with manageably low attenuation and minimal radiation pattern or beam distortion, as illustrated in FIG. 1. More specifically, the sensor 20 is mounted to the vehicle 24 and the sensor cover 22 is mounted adjacent the sensor 20 so that the sensor signals 26 are directed through the covering 22. FIG. 2 illustrates how the system will appear from the exterior of the vehicle 24.

Figure 3:
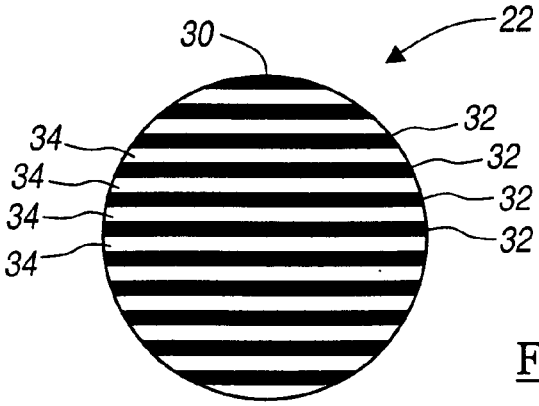
FIG. 3 is an elevational view of one embodiment of the present invention.

As shown in FIG. 3, the covering 22 includes a substrate 28 that is made from a material that is essentially transparent to high frequency signals, including but not limited to, polycarbonate. The substrate 28 has a non-planar surface 30 with a plurality of non-signal transmitting regions 32 and a plurality of signal transmitting regions 34. Each of the non-signal transmitting regions 32 of the substrate 28 is separated by at least one of the signal transmitting regions 34. Further, each of the non-signal transmitting regions 32 is spaced apart by a predetermined distance for allowing the transmission of high frequency signals 26 communicated by the high frequency sensor 20. Each of the plurality of non-signal transmitting regions 32 is covered with a metal layer or similar material layer providing a metallic appearance.

In one embodiment of the present invention, as shown in FIGS. 4(A)–4(D), the substrate 28 includes a surface having recesses 36 and peaks 34. Preferably, the recesses 36 and peaks 34 are molded into the substrate 28. The recesses 36 and peaks 34 form the non-planar surface 30 of the substrate 28. In one embodiment, the signal transmitting regions 34 of the substrate 28 correspond to the peaks 34 formed on the substrate 28 and the non-signal transmitting regions 32 of the substrate 28 correspond to the recesses 36 on the substrate 28.

However, in another embodiment the signal transmitting regions 34 of the substrate 28 correspond to the recesses 36 formed on the substrate 28 and the non-signal transmitting regions 32 of the substrate 28 correspond to the peaks 34 on the substrate 28.

A metal material 38 is applied to the non-signal transmitting regions 36 of the substrate 28. Preferably the metal material 38 is aluminum. In the final product, in one embodiment, the metal material 38 will only be present on the substrate recesses 36 and there will be no metal material present on the substrate peaks 34. In other words, there will be areas of the substrate 28 covered with metal material 32 and other areas of the substrate 28 that are not covered with metal material 34. The areas where the metal is present and forms a pattern can be described as a metal or wire network. In very general terms, in one embodiment, the signal transmitting regions are aligned generally perpendicular to the direction of the sensor signals 26 transmitted or received by the high frequency sensor 20.

In another embodiment of the present invention, an outer layer may be applied to the sensor cover. The outer layer 40 is formed from a material that is transparent to high frequency sensor signals. This outer layer 40 may be made from an environmentally stable film and may be applied directly to the substrate 28. The outer layer 40 may be applied to either the side of the substrate opposite the recesses or to the recessed side. The outer layer 40 can be attached to the substrate 28 using any number of techniques, including but not limited to, a second surface printing technique, lacquer printing, bonded appliqué or decal, or decorative in-molding.

The process of designing the non-planar surface 30 of the substrate 28 involves considering several factors. One factor includes the position of the mounted sensor 20 with respect to the cover 22. Another factor includes the desired design of the cover 22 from an elevational view. For instance, the desired design of the cover 22 may be a manufacturers logo, it may be camouflaged with the front grill of a vehicle 24, or it may be flush with the vehicle's metal bumper. Therefore, a customized design of the non-planar substrate 28 is required for each specific set of criteria.

Preferably, the substrate 28 is a molded sheet having two sides 30, 42 with the recesses 36 and peaks 24 on at least one side 30. In yet another embodiment, shown in FIGS. 3 and 4(A)–4(D), the substrate 28 is molded with a parallel line topography on one side 30. A parallel line topography means that the recesses 36 preferably appear to be a series of parallel lines from an elevational view of the non-planar side 30 of the substrate 28.

Figure 4:
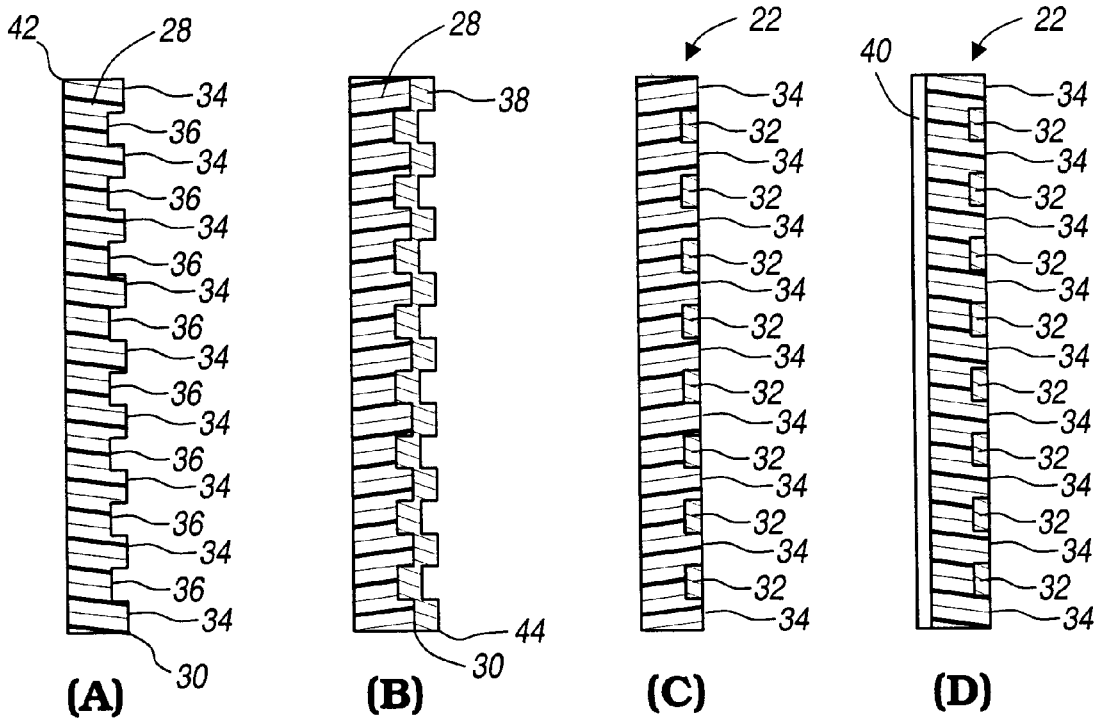
FIGS. 4(A)–4(D) are side views of one embodiment of the present invention.
Figure 5:
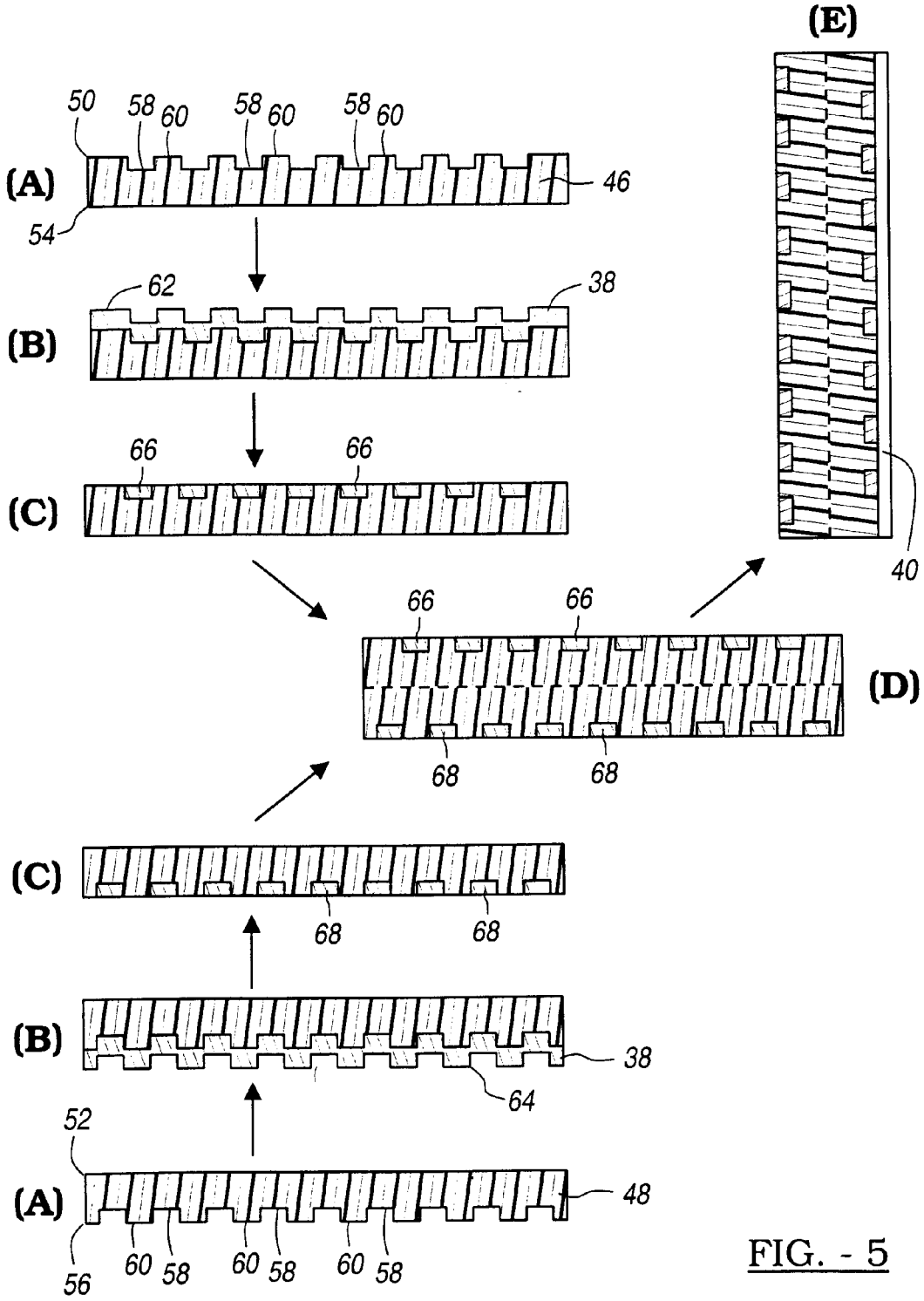
FIGS. 5(A)–5(E) are side views of a first alternative embodiment of the present invention.

As shown in FIG. 4(B), the metal material 38 is applied to the recessed surface 30 of the substrate 28. The metal material 38 can be applied using numerous techniques, including but not limited to, sputter coating or evaporation coating. The surface of the metal-coated recessed side 44 of the substrate 28 is then ground so that metal material only remains in the recesses 32. FIG. 4(C) illustrates the appearance of the substrate 28 with the recessed areas of the substrate coated with metal 32 and the substrate peaks 34 free of any metal material. As shown in FIG. 4(D), an outer layer 40 may be applied to the side 42 of the substrate opposite the recessed side 30.

An alternative embodiment, shown in FIGS. 5(A)–5(E), includes two substrate portions 46, 48 that are adhered together. Each substrate portion 46, 48 has a first side 50, 52 and a second side 54, 56. The first portion of substrate 46 has recesses 58 and peaks 60 along its first side 50. The second portion of substrate 48 has recesses 58 and peaks 60 along its second side 56. Similar to the first embodiment, metal material 38 is applied to the recessed side of each portion of substrate 50, 56. Then, the metal-coated recessed sides 62, 64 of each portion 46, 48 are ground so that metal only remains in the recessed areas 66, 68 of each portion 46, 48.

The second side 54 of the first portion of substrate 46 is adhered to the first side 52 of the second portion of substrate 48. Preferably, the portions 46, 48 of substrate are adhered in such a manner that the recesses on the first portion 66 of substrate are offset from or misaligned with the recesses on the second portion 68 of substrate. An outer layer 40 may also be applied to either the first 46 or second portion 48 of the substrate.

Figure 6:
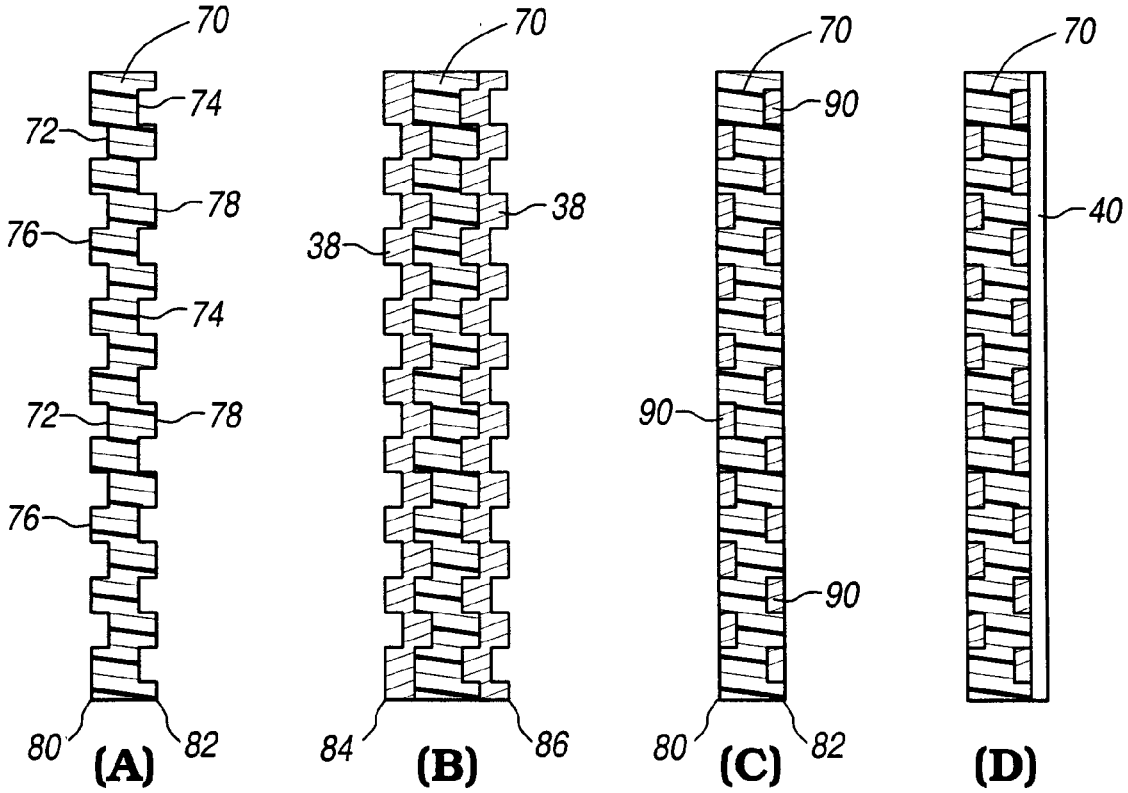
FIGS. 6(A)–6(D) are side views of a second alternative embodiment of the present invention.

Another embodiment is shown in FIGS. 6(A)–6(D). A single sheet of substrate 70 is molded with recesses 72, 74 and peaks 76, 78 on both sides 80, 82. However, the recesses 72 on the first side 80 of the sheet 70 are offset from or misaligned with the recesses 74 on the second side 82 of the sheet 70. Shown at FIG. 6(B), a metal material 38 is adhered to both sides 80, 82 of the substrate 70. Preferably, the metal material is aluminum. Shown in FIG. 6(C), each metal-coated side 84, 86 of the substrate 70 is ground so that metal material only remains in the recesses 90 on each side 80, 82. FIG. 6(D) illustrates applying an outer layer 40 to one side of the substrate. The application of the outer layer 40 is optional.

In all of the embodiments described above, the recesses had generally square shaped valleys. In still another embodiment, illustrated in FIGS. 7(A)–7(D), the recesses are generally triangular in shape. It should be noted that these generally triangular shaped recesses could be incorporated into all of the previously described embodiments in place of the generally rectangular shaped recesses.

Figure 7:
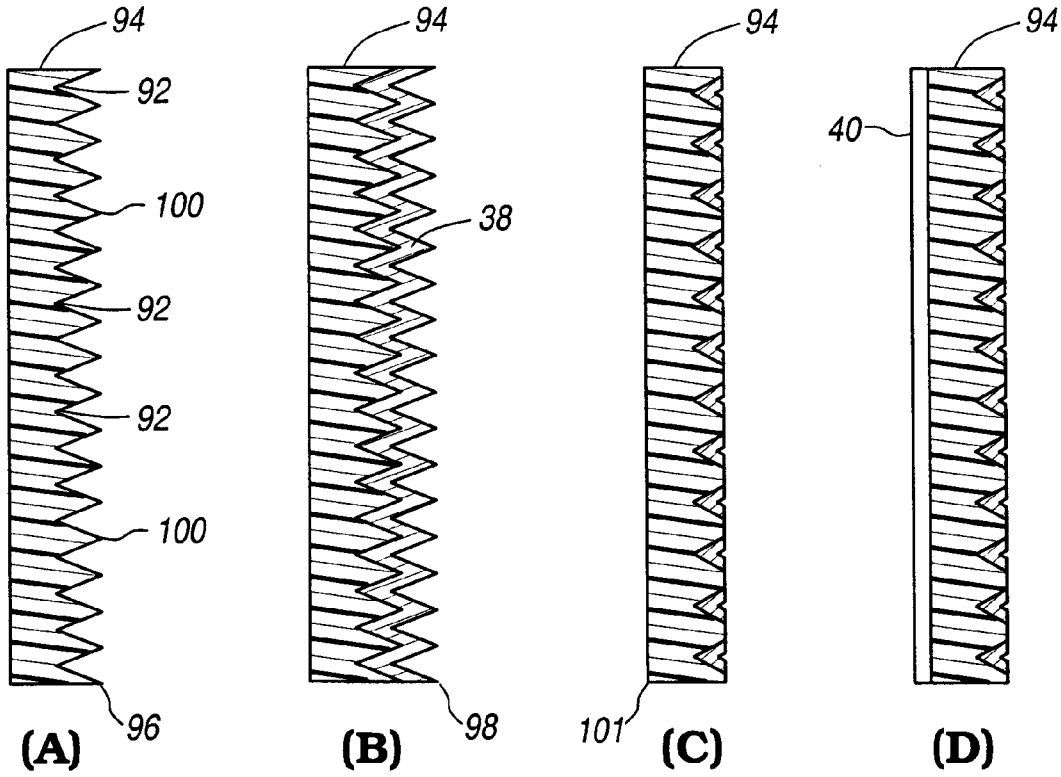
FIGS. 7(A)–7(D) are side views of a third alternative embodiment of the present invention.

In FIG. 7(A), the substrate 94 is molded with generally triangular shaped recesses 92 along one side 96. A metal material 38 is adhered to the recessed side 96 of the substrate 94 in FIG. 7(B). The recessed side of the metal-coated substrate 98 is ground in a grinding operation, as shown in FIG. 7(C), thus removing the substrate peaks 100 and revealing areas of the substrate 94 that are not metal-coated.

FIG. 7(D) illustrates the addition of an outer layer 40 to the substrate 94. The outer layer 40 is shown adhered to the side of the substrate 101 opposite the recesses. However, the outer layer could also be applied to the recessed side of the substrate.

Figure 8:
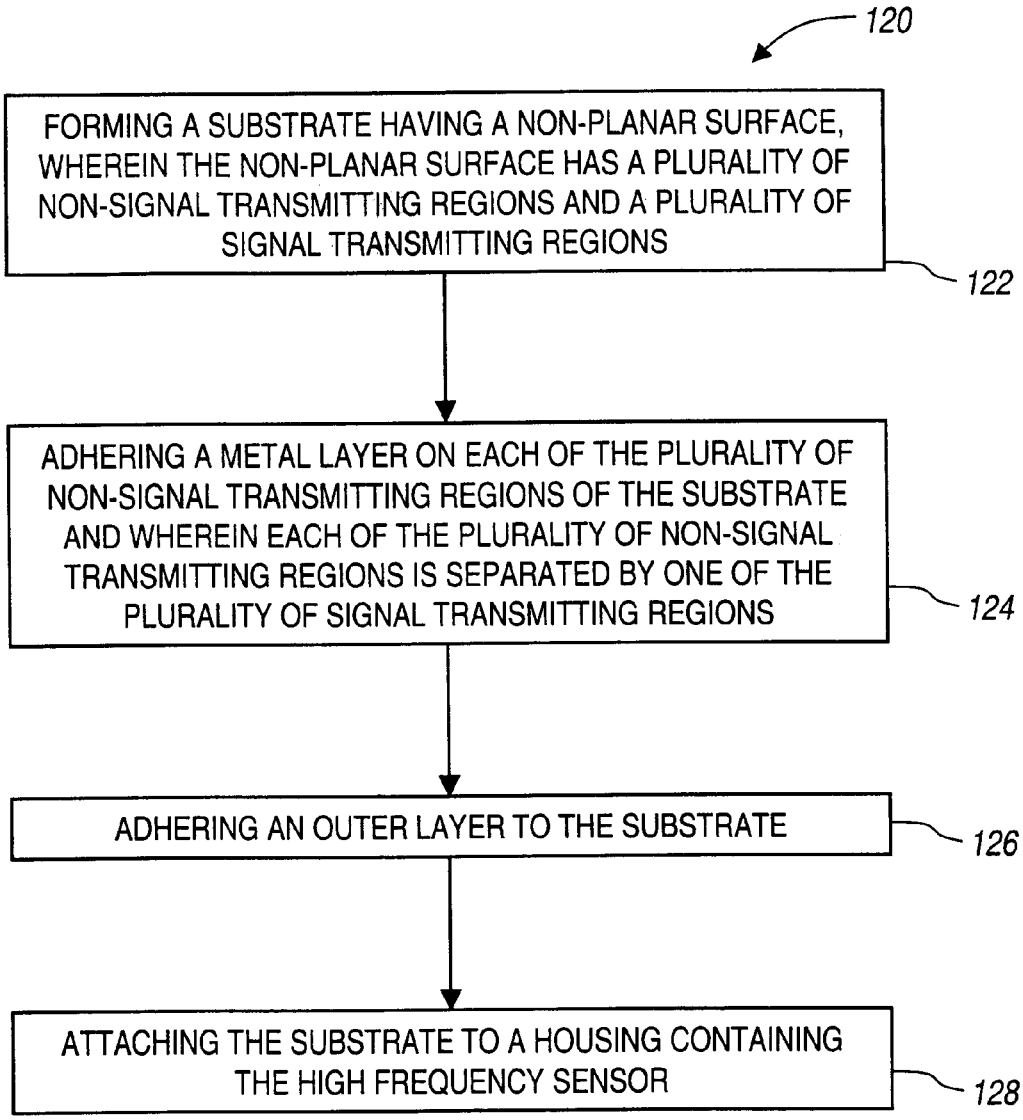
FIG. 8 is a flowchart of a method of constructing the present invention.

FIG. 8 illustrates a method of constructing a sensor cover for camouflaging a high frequency sensor, shown generally at 120. A substrate is formed with a non-planar surface, having a plurality of non-signal transmitting regions and a plurality of signal transmitting regions, at 122. Each of the non-signal transmitting regions is separated by at least one of the signal transmitting regions. Another step involves adhering a metal layer to each of the non-signal transmitting regions of the substrate, at 124. Another step that might be included is adhering an outer layer to the substrate, at 126. Yet another step involves applying the substrate to the housing containing the high frequency sensor, shown at 128. Alternatively, the substrate can be applied directly to the vehicle.

In all of the embodiments, the metal layer may be adhered to the non-planar surface of the substrate using numerous techniques, including but not limited to, sputter coating or evaporation coating. Additionally, in all of the embodiments, the metal layer may be removed from the signal transmitting region by polishing or grinding the non-planar surface.

The sensor cover may be attached to a frame that attaches to a housing holding the sensor or the housing may attach directly to the vehicle. Alternatively, the sensor cover may attach directly to a housing holding the sensor or directly to the vehicle.

As any person skilled in the art of high frequency sensor covers will recognize from the previous detailed description and from the figures and claims, modifications and changes can be made to the preferred embodiment of the invention without departing from the scope of this invention as defined in the following claims.

What is claimed is:

1. A sensor cover for camouflaging a high frequency electromagnetic wave transmitting sensor, the sensor cover comprising:

a substrate having a non-planar surface, wherein the non-planar surface has a plurality of non-signal transmitting regions and a plurality of signal transmitting regions;

a metal layer disposed on each of the plurality of non-signal transmitting regions of the substrate; and wherein each of the plurality of non-signal transmitting signal regions is separated by at least one of the plurality of signal transmitting regions.

2. The sensor cover of claim 2 wherein each of the plurality of non-signal transmitting regions is spaced apart by a predetermined distance for allowing the transmission of high frequency signals.

3. The sensor cover according to claim 1 further comprising an outer layer attached to the substrate.

4. The sensor cover according to claim 3 wherein the outer layer is attached to the substrate using a second surface printing technique.

5. The sensor cover according to a claim 3 wherein the outer layer is an environmental stable film.

6. The sensor cover according to claim 1 wherein the substrate is made from a material essentially transparent to radar signals.

7. The sensor cover according to claim 6 wherein the substrate is molded polycarbonate.

8. The sensor cover according to claim 1 wherein the metal layer is aluminum.

9. The sensor cover according to claim 1 wherein the metal layer is adhered to the substrate by sputter coating.

10. The sensor cover according to claim 1 wherein the substrate has a first side and a second side and wherein the recesses are positioned in a misaligned manner on the first and the second sides of the substrate.

11. The sensor cover according to claim 1 wherein the high frequency sensor is a radar sensor.

12. The sensor cover according to claim 11 wherein the radar sensor is capable of transmitting radar signals and receiving radar signals.

13. The sensor cover according to claim 12 wherein the signal transmitting regions are aligned generally perpendicular to the direction of a sensor signal transmitted by the high frequency sensor.

14. The sensor cover according to claim 12 wherein the signal transmitting regions are aligned generally perpendicular to the direction of a sensor signal received by the high frequency sensor.

15. A method for constructing a sensor cover for camouflaging a high frequency sensor, the method comprising:

forming a non-planar surface in a substrate, wherein the non-planar surface has a plurality of non-signal transmitting regions and a plurality of signal transmitting regions; and adhering a metal layer on each of the plurality of non-signal transmitting regions of the substrate; and wherein each of the plurality of non-signal transmitting regions is separated by at least one of the plurality of signal transmitting regions.

16. The method according to claim 15 further comprising the step of adhering an outer layer to the substrate.

17. The method according to claim 16 further comprising the step of attaching the substrate to a housing containing the high frequency sensor.

18. A sensor cover for camouflaging a high frequency electromagnetic wave transmitting sensor, the sensor cover comprising:

a substrate having a non-planar surface, wherein the non-planar surface has a plurality of non-signal transmitting regions and a plurality of signal transmitting regions, and wherein the substrate has a first substrate portion having a first side and a second side and the non-signal transmitting regions are recesses that are formed in the first side of the first substrate portion and a second substrate portion wherein the second substrate portion is adhered to the first substrate portion, the second substrate portion having a first side and a second side and recesses formed in the second side of the second substrate portion wherein metal is adhered to the recesses in the second substrate portion; and a metal layer disposed on each of the plurality of non-signal transmitting regions of the substrate, and wherein each of the plurality of non-signal transmitting regions is separated by at least one of the plurality of signal transmitting regions.

19. A sensor cover for camouflaging a high frequency electromagnetic wave transmitting sensor, the sensor cover comprising:

a substrate having a non-planar surface, wherein the non-planar surface has a plurality of non-signal transmitting regions and a plurality of signal transmitting regions, and wherein the substrate has a first substrate portion having a first side and a second side and the non-signal transmitting regions are recesses that are formed in the first side of the first substrate portion and a second substrate portion wherein the second substrate portion is adhered to the first substrate portion, the second substrate portion having a first side and a second side and recesses formed in the second side of the second substrate portion wherein metal is adhered to the recesses in the second substrate portion; and a metal layer disposed on each of the plurality of non-signal transmitting regions of the substrate, and wherein each of the plurality of non-signal transmitting regions is separated by at least one of the plurality of signal transmitting regions, and wherein the first substrate portion and the second substrate portion are adhered together such that the recesses on the first substrate portion and the recesses on the second substrate portion are misaligned.

* * * * *

UNITED STATES PATENT AND TRADEMARK OFFICE

CERTIFICATE OF CORRECTION

PATENT NO. : 6,750,819 B2
DATED : June 15, 2004
INVENTOR(S) : Samuel G. Rahaim et al.

It is certified that error appears in the above-identified patent and that said Letters Patent is hereby corrected as shown below:

Column 5,
Line 53, delete "claim 2" and substitute -- claim 1 -- in its place.

Signed and Sealed this

Sixteenth Day of November, 2004

JON W. DUDAS
*Director of the United States Patent and Trademark Office*